US008851239B2

(12) United States Patent
Nakamori

(10) Patent No.: US 8,851,239 B2
(45) Date of Patent: Oct. 7, 2014

(54) ELEVATOR TENSION MEMBER MONITORING DEVICE

(75) Inventor: Masanori Nakamori, Kanagawa-Prefecture (JP)

(73) Assignee: Otis Elevator Company, Farmington, CT (US)

( * ) Notice: Subject to any disclaimer, the term of this patent is extended or adjusted under 35 U.S.C. 154(b) by 531 days.

(21) Appl. No.: 13/148,681

(22) PCT Filed: Feb. 12, 2009

(86) PCT No.: PCT/JP2009/000552

§ 371 (c)(1), (2), (4) Date: Aug. 10, 2011

(87) PCT Pub. No.: WO2010/092618

PCT Pub. Date: Aug. 19, 2010

(65) Prior Publication Data

US 2011/0315489 A1 Dec. 29, 2011

(51) Int. Cl.
*B66B 1/34* (2006.01)
*B66B 7/12* (2006.01)

(52) U.S. Cl.
CPC ..... *B66B 7/1215* (2013.01)
USPC ..... 187/393

(58) Field of Classification Search
CPC ..... B66B 5/0018; B66B 5/0031; B66B 5/12; B66B 5/125; B66B 7/10; B66B 7/1207; B66B 7/1215; B66B 7/1223
USPC ..... 187/247, 391–393; 324/535, 539, 542, 324/206, 207.13, 207.17; 73/158, 597, 598, 73/602, 620, 632, 643
See application file for complete search history.

(56) References Cited

U.S. PATENT DOCUMENTS

| | | | | | |
|---|---|---|---|---|---|
| 3,386,145 | A * | 6/1968 | Harris | 73/160 |
| 3,405,556 | A * | 10/1968 | Gonsalves et al. | 73/160 |
| 3,902,364 | A * | 9/1975 | Craig et al. | 73/160 |
| 4,145,920 | A | 3/1979 | Yamagami | |
| 4,935,699 | A * | 6/1990 | Boenning | 324/555 |
| 5,804,964 | A | 9/1998 | Hamelin et al. | |
| 6,073,728 | A * | 6/2000 | Olsen et al. | 187/414 |
| 6,653,943 | B2 * | 11/2003 | Lamb et al. | 340/677 |

(Continued)

FOREIGN PATENT DOCUMENTS

| | | |
|---|---|---|
| JP | 2002003119 | 1/2002 |
| JP | 2006105956 A | 4/2006 |

(Continued)

OTHER PUBLICATIONS

International Preliminary Report on Patentability for International application No. PCT/JP2009/000552 mailed Aug. 25, 2011.
International Search Report and Written Opinion of the International Searching Authority for International application No. PCT/JP2009/000552 mailed Oct. 30, 2009.

*Primary Examiner* — Anthony Salata
(74) *Attorney, Agent, or Firm* — Carlson, Gaskey & Olds

(57) ABSTRACT

A tension member monitoring device is provided with at least one contact sensor (21) and a defect determining device (20). The contact sensor (21), which is arranged next to a corresponding tension member (3) without touching the tension member (3), is configured to output a contact signal when contacted. The defect determining device (20), which receives the contact signal, is configured to determine whether there is a defect in the tension member (3), based on the contact signal.

24 Claims, 5 Drawing Sheets

(56) References Cited

U.S. PATENT DOCUMENTS

| | | | | |
|---|---|---|---|---|
| 6,923,065 | B2 * | 8/2005 | Smith et al. | 73/597 |
| 7,880,476 | B1 * | 2/2011 | McKenzie et al. | 324/543 |
| 8,390,281 | B2 * | 3/2013 | Yoshioka et al. | 324/240 |
| 8,424,653 | B2 * | 4/2013 | Stucky et al. | 187/393 |
| 8,476,898 | B2 * | 7/2013 | Nishiyori et al. | 324/240 |
| 8,536,861 | B2 * | 9/2013 | Furusawa et al. | 324/240 |
| 2003/0062226 | A1 | 4/2003 | Stucky et al. | |
| 2011/0284331 | A1 | 11/2011 | Stucky et al. | |
| 2013/0024135 | A1 * | 1/2013 | Blum | 702/38 |

FOREIGN PATENT DOCUMENTS

| | | | |
|---|---|---|---|
| JP | 2007022765 | A | 2/2007 |
| JP | 2007230731 | A | 9/2007 |
| JP | 2008050140 | | 3/2008 |
| JP | 2008143645 | A | 6/2008 |
| SU | 1500605 | A1 | 8/1989 |

* cited by examiner

ELEVATOR TENSION MEMBER MONITORING DEVICE

TECHNICAL FIELD

This invention relates to elevator tension member monitoring device.

BACKGROUND ART

The present invention relates to a tension member monitoring device that monitors the tension member(s) used in an elevator system and senses defects therein. A typical elevator system includes a hoistway, a hoist positioned at the uppermost part of the hoistway, an elevator car guide rail and a counterweight guide rail mounted in the hoistway, and an elevator car and a counterweight that move up and down in the hoistway along the guide rails. The car and the counterweight are connected to each other by tension member such as a wire rope or belt (regardless of whether the belt itself contains a wire rope). The tension member is driven by the hoist, which moves the car and counterweight along the guide rails.

A wire rope is typically constructed by twisting together strands made up of twisted multiple wires. Breakage, wear and the like sometimes occur in the wires or strands that constitute the rope due to the effects of frequent bending, tensile stress, abrasion, etc.

For this reason, inspection to confirm whether there are rope defects is performed periodically. In the past, visual inspection by a technician and inspection with an electromagnetic defect detector have been used together as the method of inspecting for wire breaks in the rope used for elevators.

The rope defect sensing device disclosed in Japanese Unexamined Patent Application Publication No. 2004-149317 may be given as an example using magnetic inspection. This rope defect sensing instrument comprises a sensing part that magnetically senses defects, such as wire breakage, and a signal processing part that processes signals from the sensing part. When there is a break in a wire, the magnetic field is disrupted at the location of the sensed part in the channel through which the rope passes, the disruption is captured by the sensor as a signal that is output to the signal processing part, the break location in the rope is measured, and the defect in the rope is sensed.

As another conventional example, as disclosed in Japanese Unexamined Patent Application Publication No. 2001-63938, which discloses a method in which, while an inspection device (in which a cord is stretched on a U-shaped frame) is held in a worker's hand, the device is brought directly into contact with the elevator rope while moving; vibrations transmitted from defective locations on the rope are confirmed manually by the worker himself.

Patent Citation 1: Japanese Unexamined Patent Application Publication No. 2004-149317

Patent Citation 2: Japanese Unexamined Patent Application Publication No. 2001-63938

DISCLOSURE OF INVENTION

Technical Problem

However, the disadvantages of the sensing device in Japanese Unexamined Patent Application Publication No. 2004-149317 are that the device is expensive, and at the same time, in order to sense the slight disruption in the magnetic field caused by wire breakage with good precision, the elevator must be operated at a low speed for inspection, since, at normal operating speeds, the sensing precision is low.

Additionally, in Japanese Unexamined Patent Application Publication No. 2001-63938, the vibration transmitted from defective locations is confirmed manually by the worker himself over the entire length of the rope while the worker brings an inspection device in contact with the rope while it is moving. Moreover, the positions of defective locations must also be specified by the worker, which is disadvantageous in that the process is time and labor intensive. There is also the problem that the process is dangerous, since the worker must bring the hand-held device into direct contact with the elevator rope while it is moving.

The present invention is devised to solve such conventional problems and to provide an inexpensive and simple to use elevator rope monitoring device to detect rope defects.

Technical Solution

It is to be understood that both the foregoing general description and the following detailed description are exemplary and explanatory only, and are not restrictive of the invention as claimed.

An embodiment of a tension member monitoring device based on the present invention is provided with at least one contact sensor and a defect determining device. The contact sensor, which is arranged next to a corresponding tension member without touching the tension member, is configured to output a contact signal when contacted. The defect determining device, which receives the contact signal, is configured to determine whether there is a defect in the tension member, based on the contact signal.

An embodiment of an elevator system provided with a tension member monitoring device based on the present invention is provided with an elevator car, a counterweight, a hoist, at least one elevator tension member, and a tension member monitoring device. The tension member monitoring device includes a defect determining device and at least one contact sensor arranged next to a corresponding tension member without touching the tension member. The contact sensor is configured to output a contact signal when contacted. The defect determining device, which receives the contact signal, is configured to determine whether there is a defect in the tension member, based on the contact signal.

An embodiment of a tension member monitoring method based on the present invention includes a step in which at least one contact sensor is arranged next to a corresponding tension member without touching the tension member, a step in which contact between the contact sensor and the tension member causes the contact sensor to output a defect detected contact signal, and a step in which defects in the tension member are determined based on the contact signal.

BRIEF DESCRIPTION OF THE DRAWINGS

These and other features, aspects, and advantages of the present invention will become apparent from the description, appended claims, and the accompanying exemplary embodiments shown in the drawings, which are hereafter briefly described.

EXPLANATION OF REFERENCE

Figure 1:
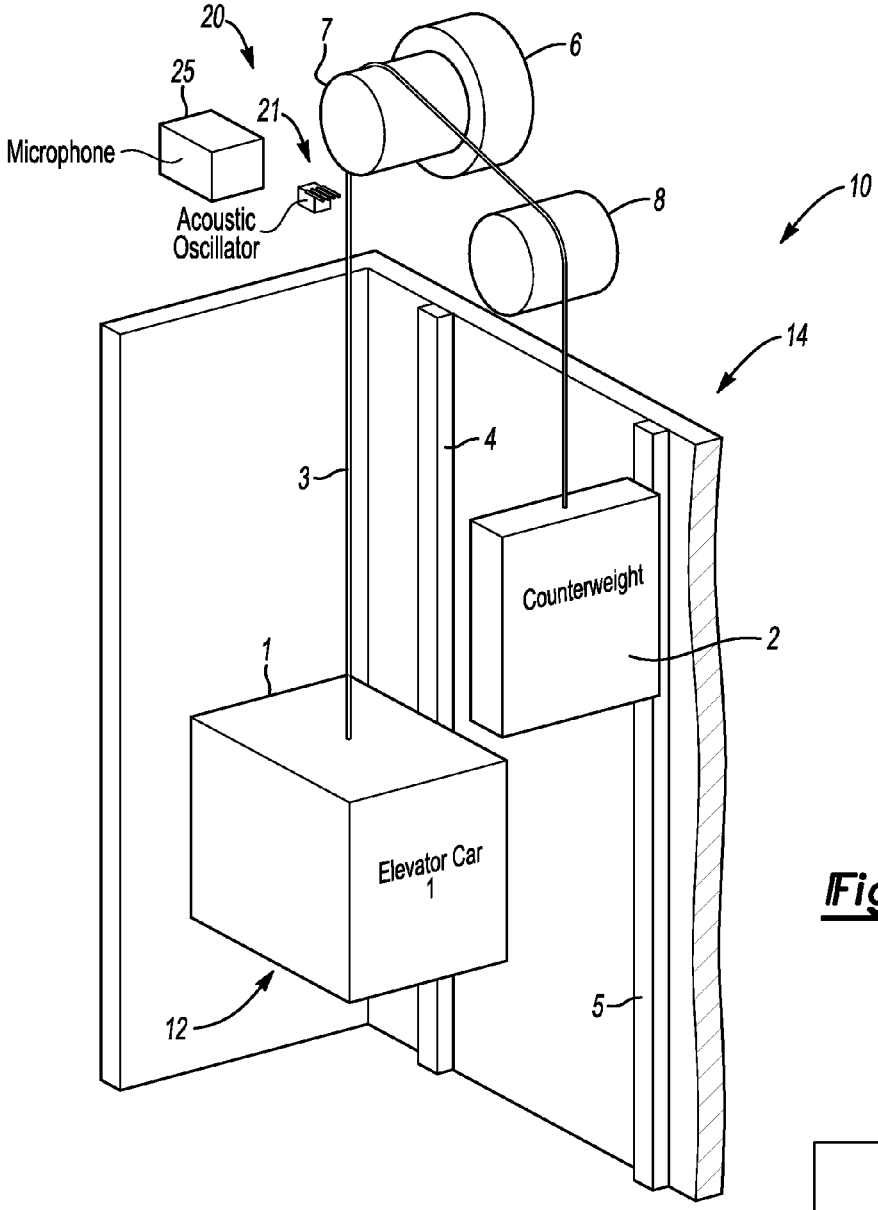
FIG. 1 shows an elevator system in which an embodiment of a tension member monitoring device of the present invention is installed.

1 Elevator car
2 Counterweight
3 Tension member
4 Car guide rail
5 Counterweight guide rail
6 Hoist
7 Drive sheave
8 Idler sheave
10 Elevator system
12 Hoistway
14 Machine room
20 Tension member defect determining device
21 Acoustic oscillator
22 Support member
23 Vibration plate
23*a* Vibration plate front end
24 Support member front edge
25 Microphone
28 Strand breakage or wire breakage
30 Sensing circuit
32 Bandpass filter
34 Comparator
36 Memory
40 Rotary encoder
50 Elevator controller
60 Public circuit
70 Monitoring center

BEST MODE FOR CARRYING OUT THE INVENTION

Embodiments of the invented elevator tension member defect determining device according to the present invention are explained below based on figures. Efforts have been made throughout the drawings to use the same or similar reference numerals for the same or like components.

Referring to the figures, hoist 6 provided with drive sheave 7 is installed in machine room 14 positioned at the uppermost part of hoistway 12. One end of at least one elevator tension member 3 is connected to elevator car 1, and the other end is connected to counterweight 2. When the tension member 3 (which may be, for example, a wire rope, a belt, etc.) is driven by hoist 6 via idler sheave 8 and drive sheave 7 provided with hoist 6, car 1 and counterweight 2 respectively move along car guide rails 4 (one of which is shown in FIG. 1) and counterweight guide rails 5 (again, one of which is shown in FIG. 1).

Figure 4:
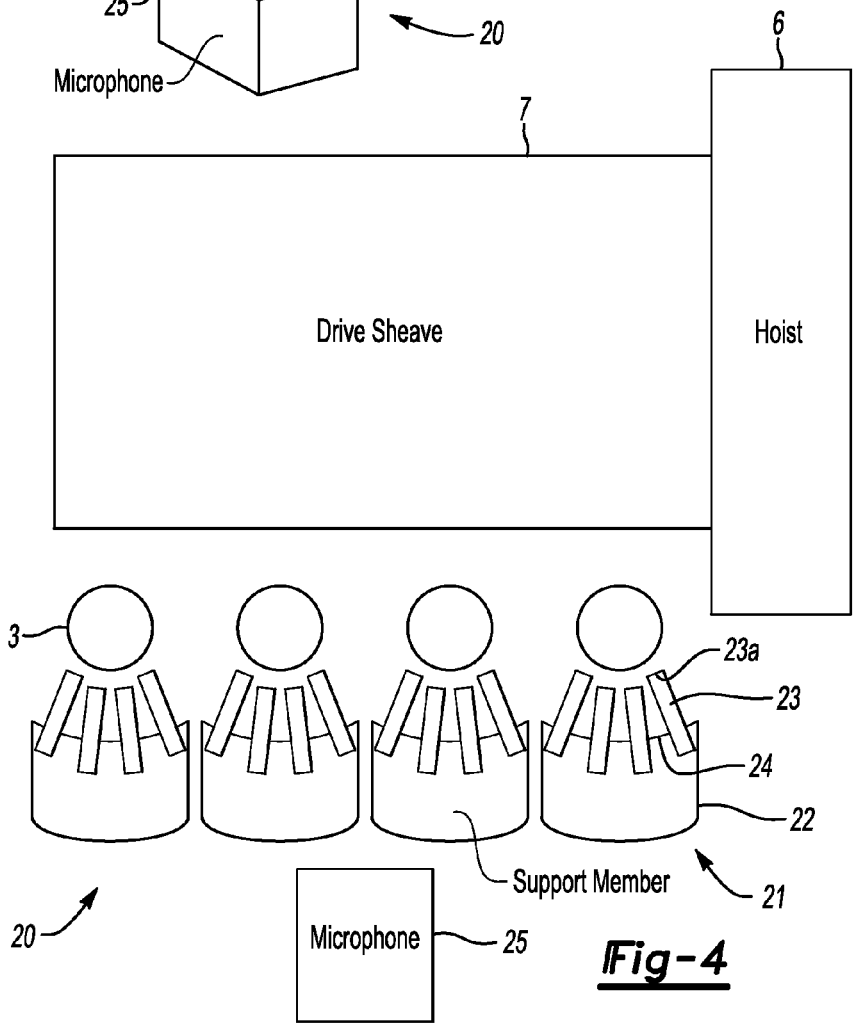
FIG. 4 is a top view of the tension member monitoring device of FIG. 3 cut away at line Iv-Iv.
Figure 5:
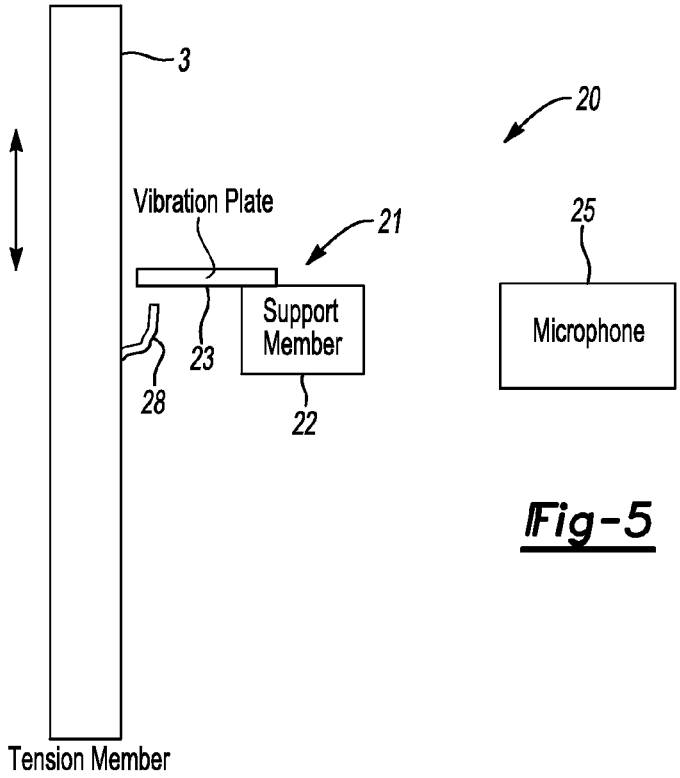
FIG. 5 is a side view of the tension member monitoring device of FIG. 3.

Tension member defect determining device 20 of the present invention is provided with at least one contact sensor, which in the shown embodiments is an acoustic oscillator 21. Acoustic oscillator 21 is installed opposite tension member 3 inside machine room 14 and adjacent drive sheave 7. Acoustic oscillator 21 is provided with support member 22, and at least one vibration plate 23 (FIG. 1 shows a plurality of vibration plates 23) mounted cantilevered on support member 22. The vibration plates 23, which are made of sheet metal, have a long, thin rectangular shape and extend toward tension member 3. The vibration plates 23 associated with a particular acoustic oscillator 21 have substantially the same length so as to have substantially the same natural vibration frequency. The vibration plates 23 are arranged at substantially equal spacing along front edge 24 of support member 22 facing and extending toward a corresponding tension member 3. The spacing between adjacent vibration plates 23 is less than the thickness (or diameter) of separable components (such as wires) in the tension member 3. In addition, the plurality of vibration plates 23 may be arranged so that front ends 23*a* that face tension member 3 surround part of the outer periphery of tension member 3 in the form of an arc (FIG. 4). Thus, the spacing between the front end 23*a* of each vibration plate 23 and tension member 3 will be substantially equal. The spacing between front ends 23*a* of vibration plates 23 and tension member 3 is set to around several millimeters, for example, so that vibration plates 23 will not touch tension member 3, which moves when the elevator is operated normally. Therefore, when there are no defects in tension member 3, vibration plates 23 will not touch tension member 3. However, if there are defective locations, such as breaks 28 (such as strand breaks or wire breaks) in the tension member 3, strands or wires projecting from the outer peripheral surface of tension member 3 at the location of the break 28 will touch a vibration plate 23 when the location of the break 28 passes the vibration plate 23. When the break 28 touches the vibration plate 23, the vibration plate 28 vibrates and produces a contact signal in the form of a sound.

Referring to FIG. 4, with an application example of the present invention, elevator system 10 is provided with four tension members 3, each of which is associated with a corresponding acoustic oscillator 21 that is installed opposite the respective tension member. The lengths of the vibration plates 23 of the four acoustic oscillators 21 are different, and therefore the natural vibration frequencies of the acoustic oscillators 21 are different, for example, 500 Hz, 800 Hz, 1 kHz and 1.5 kHz. When there is a defect in one tension member 3, a vibration plate 23 of the associated acoustic oscillator 21 is touched by strands or wires projecting from the breakage 28 in the tension member 3, thereby causing the associated acoustic oscillator 21 to produce a noise with a natural vibration frequency that is distinct from the other vibration plates 23 of the other acoustic oscillators 21. As a result, the acoustic oscillator 21 that was touched by the wire or strand projecting from a break 28 (and, therefore, the tension member 3 corresponding to the acoustic oscillator 21), can easily be specified by the frequency of the sound from the contacted vibration plate 23. Although in the application example shown, four tension members 3 are used, and four corresponding vibration plates 23 are provided with the acoustic oscillators corresponding to each tension member 3, the invention is not restricted in this way.

Figure 6:
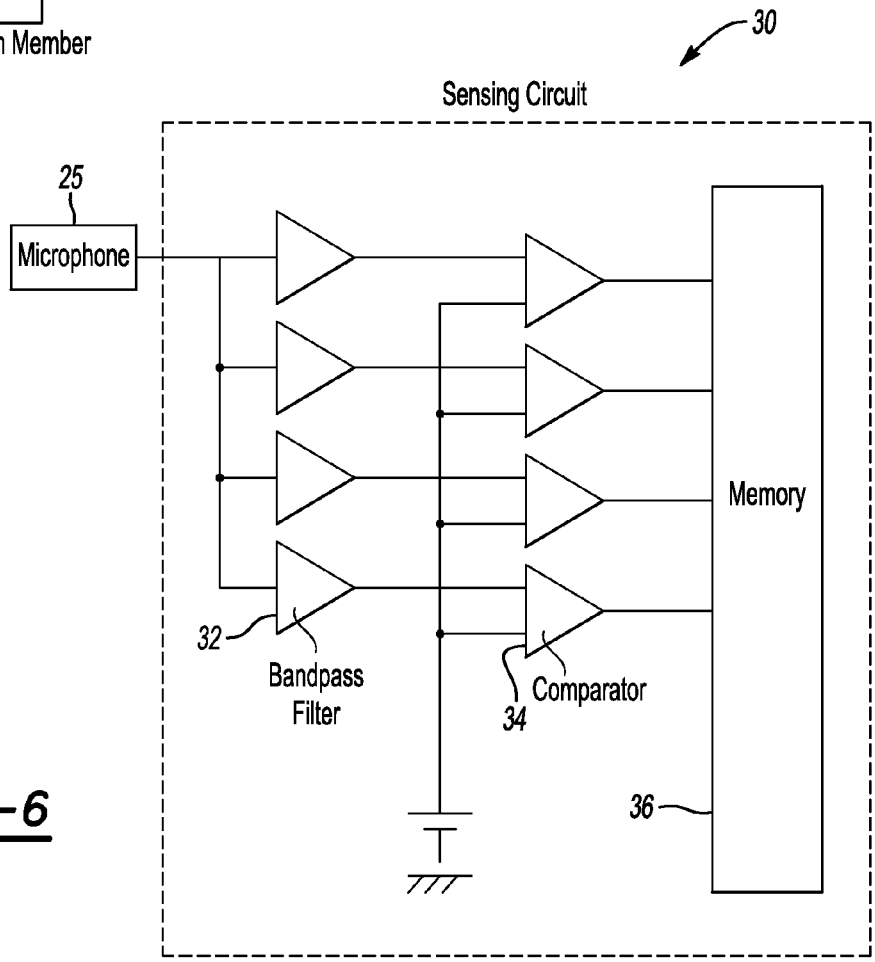
FIG. 6 is a circuit diagram of a detection circuit according to an embodiment of the present invention.

In addition, referring to FIG. 6, tension member defect determining device 20, which is arranged near acoustic oscillators 21, is provided with microphone 25 (that detects sound from acoustic oscillators 21) and sensing circuit 30 connected to microphone 25. Sensing circuit 30 is provided with bandpass filter 32 that filters the signals sensed by microphone 25, comparator 34, and memory 36. The acoustic signal sensed by microphone 25 includes peripheral noise, in addition to sound from acoustic oscillators 21. To account for (and substantially eliminate the effects of) the peripheral noise, bandpass filter 32 separates a frequency signal in the range that includes the natural vibration frequency of the vibration plates 23 from the output signal from microphone 25, and outputs the filtered signal to comparator 34. Comparator 34 compares a reference signal and the filtered signal that is outputted by the bandpass filter 32. If the filtered signal is greater than the reference signal, the comparator 34 outputs a defect detection signal.

Figure 2:
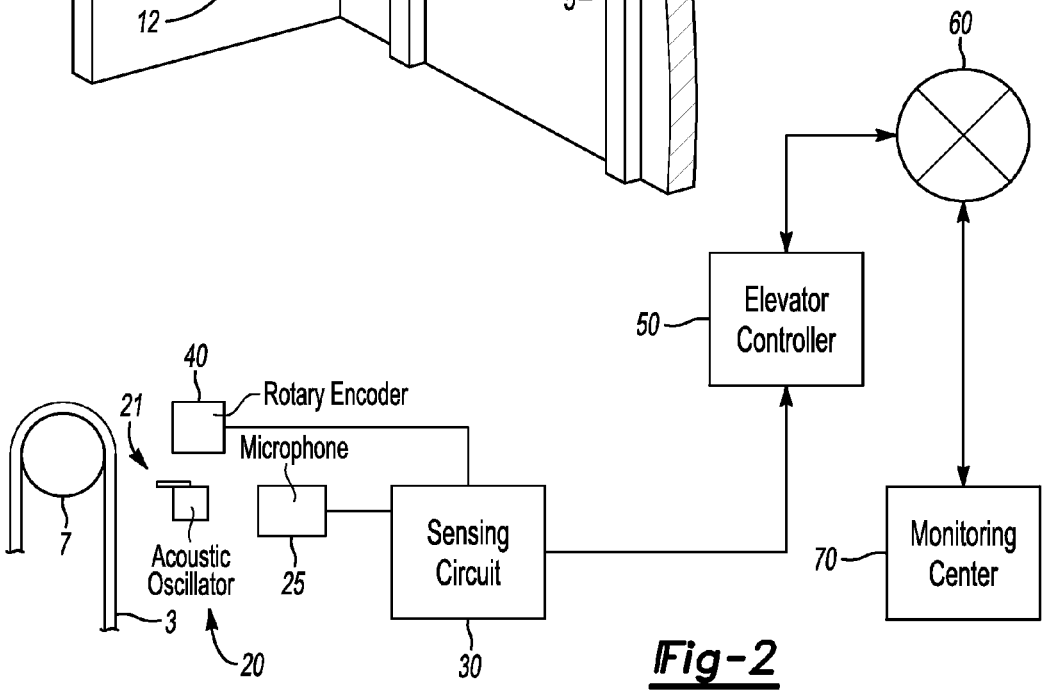
FIG. 2 is a block diagram of the tension member monitoring device of FIG. 1.
Figure 3:
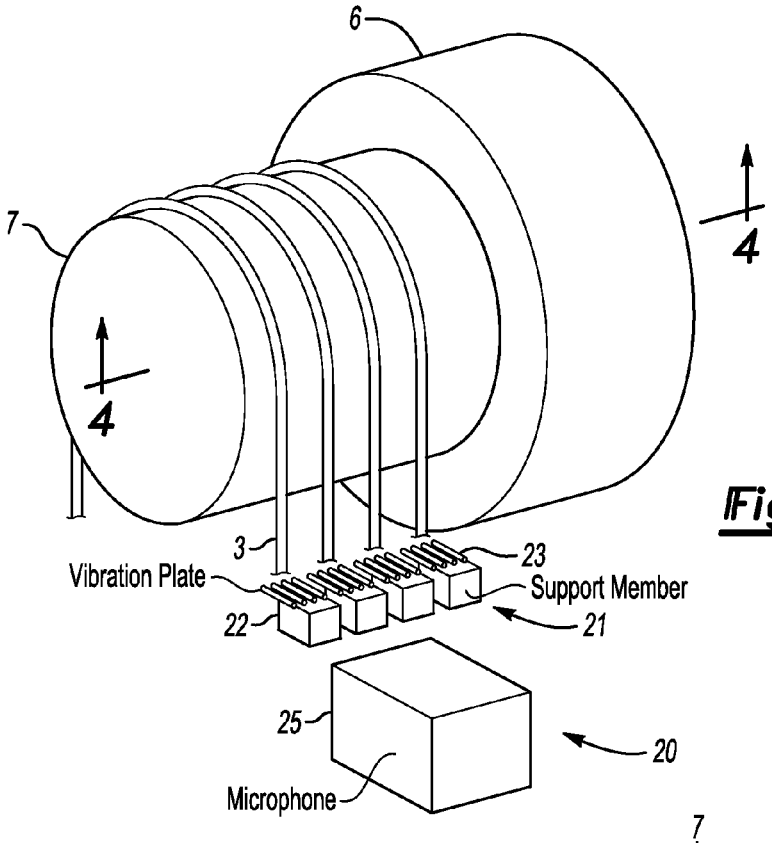
FIG. 3 is a perspective view of a hoist, a plurality of tension members, and the tension member monitoring device of FIG. 1.

Elevator system 10 is provided with rotary encoder 40 connected to the hoist (FIG. 2). Rotary encoder 40 is synchronized to the movement of the tension members in the length direction, and generates addresses that specify the positions of the various locations on the tension members in the length direction. Addresses generated by rotary encoder 40 are recorded in memory 36 in sensing circuit 30. When a defect detection signal is outputted by comparator 34, the existence of the defect is recorded in the memory address corresponding to the defect's location (as determined by the rotary encoder 40). Referring to FIG. 2, sensing circuit 30 is connected to elevator controller 50. Elevator controller 50 transmits data to monitoring center 70 over public circuit 60 to make defects in tension members 3 known. Locations of defects on tension members 3 can easily be retrieved by reading the memory data that include the defect detection signals in the addresses.

Figure 7:
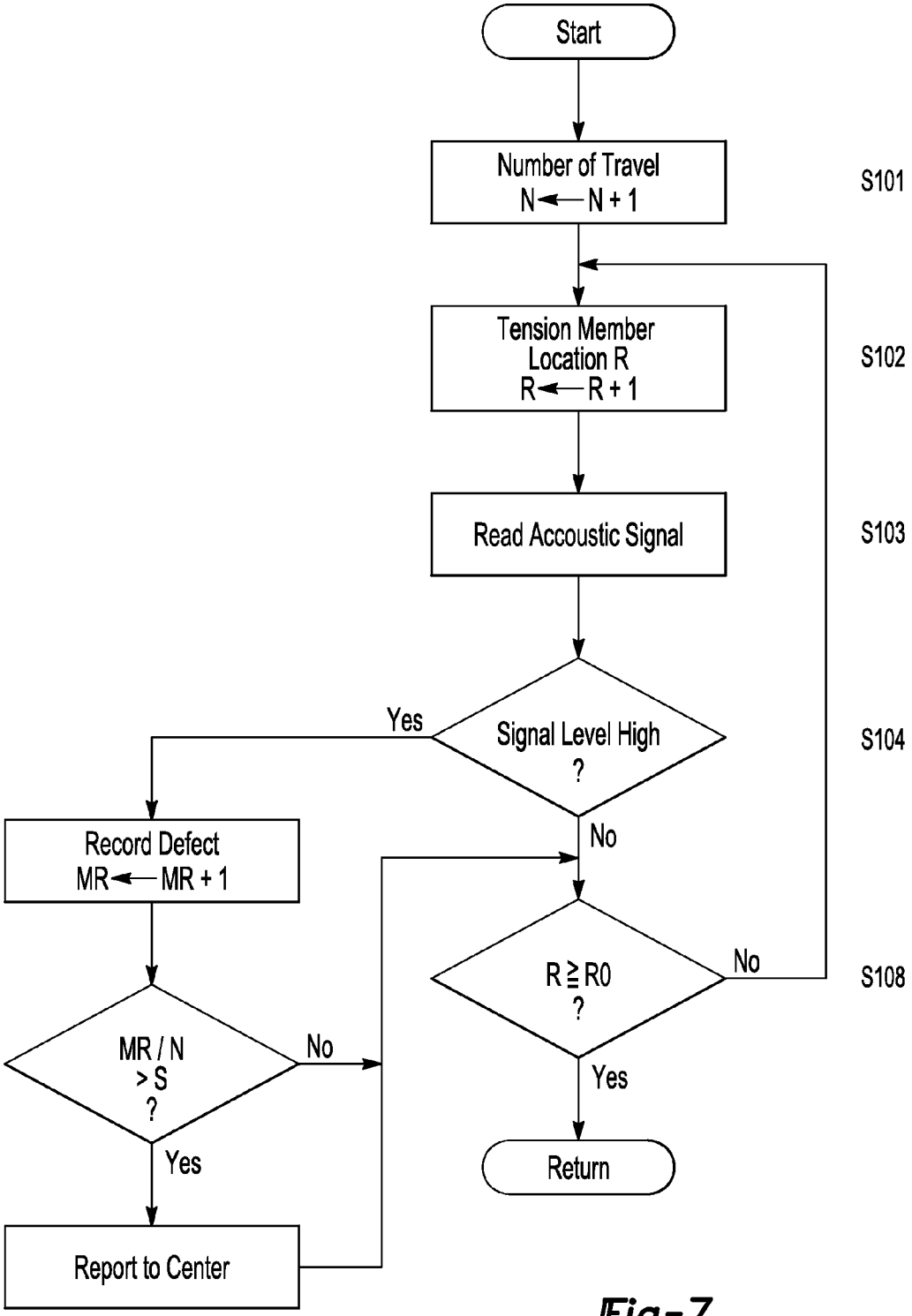
FIG. 7 is a flow chart of the processing steps used in an embodiment of a tension member monitoring method of the present invention.

FIG. 7 is a flow chart showing an embodiment of a processing procedure of the tension member defect determining device 20 of the present invention.

The tension member defect determining device of the present invention constantly monitors elevator tension members 3 during normal operation. First, a counter that indicates the number of travel times N is incremented each time the elevator is operated (step 101). At step 102, a counter that indicates the location R of the tension member as it passes acoustic oscillator 21 is incremented synchronously with rotary encoder 50. Then, the filtered signal at location R is read (step 103), and compared with a reference value (step 104).

Here, if the signal level exceeds the reference value, process control proceeds to step 105, and the counter that counts the number of times a defect is detected MR at location R is incremented. Next, at step 106, the number of times a defect is detected MR is divided by number of travel times N, and is compared with threshold value S. If the defect occurrence ratio (MR/N) exceeds threshold value S, it is determined that there is a defect in the rope, and this is reported to monitoring center 70 over public circuit 60 (step 107). On the other hand, if threshold value S has not been exceeded, it is determined that there are no tension member defects, and process control proceeds to step 108.

At step 104, if the signal level does not exceed the reference value, as well, process control proceeds to step 108. At step 108, whether a defect has been detected over the entire length of the tension member is confirmed, and after the value of location R reaches a predetermined maximum value ($R \geq R0$), it is determined that inspection over the entire length of the tension member has been completed, and process control returns to step 101. If the value of location R has not reached the maximum value, process control returns to step 102, and the processing described above is repeated for next tension member location R.

In this way, with the present invention, the entire length of the tension member is inspected multiple times, and tension member defects are determined from the ratio of the number of times defects are detected at a specific location to the number of travel times, so that tension member defects can be specified more accurately without the detection results being affected by sound or noise in the hoistway.

Vibration plate 23 of acoustic oscillator 21 is also constituted so that it will break if it is subjected to impact greater than a specified amount. Therefore, workers can also confirm tension member defects by damage to vibration plate 23.

The present invention was explained based on the application examples in FIGS. 1-7 above, but the present invention is not limited to the constitution described above.

In the application example shown, the elevator system of the present invention is configured as 1:1 roping, and four tension members are used, but it is not limited to this, and the tension member defect determining device of the present invention can be used effectively even with another roping configuration.

The tension member defect determining device in the application example is used for an elevator system that has a machine room, and is installed near drive sheave 7 of hoist 6 disposed in machine room 14, but the tension member defect determining device of the present invention could also be used for a machine room-less type of elevator system, and said monitoring device could also be disposed near idler sheave 8.

Figure 8:
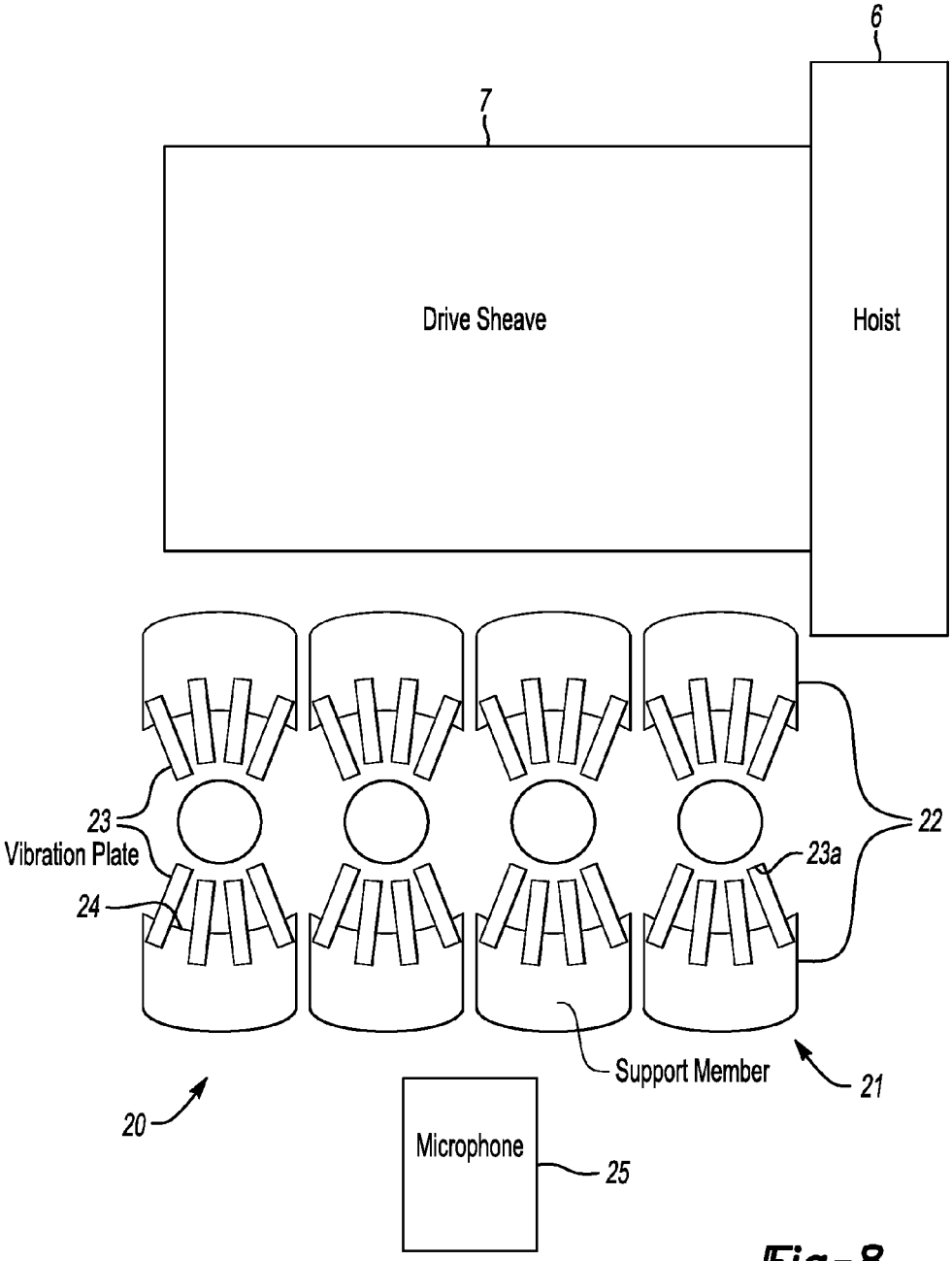
FIG. 8 is a top view of an alternate embodiment of a tension member monitoring device of the present invention.

In the application example shown, acoustic oscillators 21 of tension member defect determining device 20 are installed facing one side of tension members 3, but acoustic oscillators 21 could also be disposed on the entire periphery of tension members 3, as shown in FIG. 8. Similarly, although the disclosed embodiments include acoustic oscillators 23 employing vibration plates 21 as the contact sensor, the contact sensor could be electric switches, potentiometers, etc. that, when contacted by a wire or strand breakage 28, would output a contact signal indicative of such contact.

With the application example of the present invention, when a tension member defect is confirmed, it is reported to a monitoring center in real time and the data are confirmed at a remote location, but if the defect state is of a permitted degree, the data could be stored in the memory of the detection circuit for a fixed period, and a worker could confirm it during routine maintenance.

With the tension member defect determining device of the present invention, multiple tension members can constantly be monitored with a simple constitution. It is not necessary for a worker to bring a sensing device into contact with the tension member as done conventionally, so that worker safety is ensured, and a reduction of labor and inspection time is realized. In addition, it is not necessary for the worker himself to determine tension member defects visually or audibly, so that tension member defects can be detected more accurately without individual perceptual differences.

In addition, with the tension member defect determining device of the present invention, a defective location in a tension member can be specified easily and accurately in one or more ropes. Therefore, access to defective tension member locations, creating of reports, etc., during maintenance and inspection are simplified.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the claims.

The invention claimed is:

1. A tension member monitoring device comprising:

at least one contact sensor arranged next to a corresponding tension member without touching the tension member, wherein the contact sensor is configured to output a contact signal when contacted;

a defect determining device that receives the contact signal and that is configured to determine whether there is a defect in the tension member, based on the contact signal; and a device that is configured to determine locations on the tension member that pass the contact sensor wherein the at least one contact sensor comprises:

a vibration plate arranged next to the corresponding tension member; and an acoustic sensor that is configured to output an acoustic sensor output signal as the contact signal and that is disposed opposite the vibration plate, and wherein the defect determining device comprises a filter that is configured to separate a frequency signal, which is in the range that includes the natural vibration frequency of the vibration plate, from the acoustic sensor output signal.

2. The tension member monitoring device of claim 1, wherein the defect determining device is configured to determine whether there is a defect in the tension member, based on said frequency signal.

3. The tension member monitoring device of claim 1, comprising a plurality of tension members and corresponding contact sensors, and wherein each contact sensor is configured to output a different contact signal to the defect determining device.

4. The tension member monitoring device of claim 3, wherein each of the contact sensors is a vibration plate and the natural vibration frequency of the vibration plates corresponding to each of the tension members is different.

5. The tension member monitoring device of claim 1, comprising a defect storage device that stores defects associated with the locations of the tension member that are sensed.

6. The tension member monitoring device of claim 1, wherein the defect determining device determines tension member defects from the number of times a defect is sensed at a specific location.

7. The tension member monitoring device of claim 1, comprising a plurality of contact sensors arranged opposite to the tension member and enclose part of the periphery of the tension member.

8. A tension member monitoring device comprising:

at least one contact sensor arranged next to a corresponding tension member without touching the tension member, wherein the contact sensor is configured to output a contact signal when contacted;

a defect determining device that receives the contact signal and that is configured to determine whether there is a defect in the tension member, based on the contact signal; and a device that is configured to determine locations on the tension member that pass the contact sensor wherein the defect determining device measures the number of travel times, and determines tension member defects from the ratio of the number of times a defect is sensed at a specific location to the number of travel times.

9. The tension member monitoring device of claim 1, wherein the tension member comprises a wire rope.

10. The tension member monitoring device of claim 1, wherein the tension member comprises a belt.

11. An elevator system, comprising:

an elevator car, a counterweight, a hoist, a plurality of elevator tension members; and a tension member monitoring device including:

at least one contact sensor respectively arranged next to a corresponding tension member without touching the tension member, wherein the contact sensor is configured to output a contact signal when contacted, each contact sensor is configured to output a different contact signal wherein each of the contact sensors comprises a vibration plate and wherein the natural vibration frequency of the vibration plates corresponding to each of the tension members is different;

a defect determining device that receives the contact signal and that is configured to determine whether there is a defect in the tension member, based on the contact signal; and a device that is configured to determine locations on the tension member that pass the contact sensor.

12. The elevator system of claim 11, wherein the at least one contact sensor comprises:

a vibration plate arranged next to the corresponding tension member, and an acoustic sensor that is configured to output an acoustic sensor output signal as the contact signal and that is disposed opposite the vibration plate, and wherein the defect determining device comprises a filter that is configured to separate a frequency signal, which is in the range that includes the natural vibration frequency of the vibration plate, from the acoustic sensor output signal.

13. The elevator system of claim 11, wherein the defect determining device is configured to determine whether there is a defect in the tension member, based on said frequency signal.

14. The elevator system of claim 11, comprising a defect storage device that stores defects associated with the locations of the tension member that are sensed.

15. The elevator system of claim 11, comprising a plurality of contact sensors arranged opposite to the tension member and enclosing part of the periphery of the tension member.

16. The elevator system of claim 11, wherein the defect determining device determines tension member defects from the number of times a defect is sensed at a specific location.

17. The elevator system of claim 11, wherein the defect determining device measures the number of travel times, and determines tension member defects from the ratio of the number of times a defect is sensed at a specific location to the number of travel times.

18. The elevator system of claim 11, wherein the tension member comprises a wire rope.

19. The elevator system of claim 11, wherein the tension member comprises a belt.

20. A tension member monitoring method comprising the steps of:

arranging at least one contact sensor next to a corresponding tension member without touching the tension member, providing a defect detected contact signal from the contact sensor responsive to contact between the contact sensor and the tension member, determining locations on the tension member that pass the contact sensor;

determining a number of travel times; and determining defects in the tension member based on the contact signal from a ratio of a number of times defects are sensed at a specific location to the number of travel times.

21. A tension member monitoring method comprising the steps of:

arranging at least one contact sensor next to a corresponding tension member without touching the tension member, providing a defect detected contact signal from the contact sensor responsive to contact between the contact sensor and the tension member, determining defects in the tension member based on the contact signal;

determining locations on the tension member that pass the contact sensor; and providing a plurality of tension members and corresponding contact sensors, and wherein each of the contact sensors output a different contact signal wherein each of the contact sensors comprises a vibration plate, and each of the vibration plates has a different natural vibration frequency.

22. The tension member monitoring method of claim 20, comprising storing information regarding defects associated with the locations of the tension member.

23. The tension member monitoring method of claim 20, comprising arranging a plurality of contact sensors opposite to the tension member and enclosing part of the periphery of the tension member.

24. The tension member monitoring method of claim 20, comprising counting the number of times defects are detected at a specific location, and determining tension member defects from the number of times defects are detected.

* * * * *